US010336354B2

(12) United States Patent
Kono

(10) Patent No.: US 10,336,354 B2
(45) Date of Patent: Jul. 2, 2019

(54) LOCATING TRAIN EVENTS ON A RAILWAY NETWORK

(71) Applicant: HITACHI, LTD., Chiyoda-ku, Tokyo (JP)

(72) Inventor: Toshiaki Kono, Tokyo (JP)

(73) Assignee: HITACHI, LTD., Tokyo (JP)

( * ) Notice: Subject to any disclaimer, the term of this patent is extended or adjusted under 35 U.S.C. 154(b) by 251 days.

(21) Appl. No.: 15/247,528

(22) Filed: Aug. 25, 2016

(65) Prior Publication Data

US 2017/0057527 A1 Mar. 2, 2017

(30) Foreign Application Priority Data

Aug. 27, 2015 (GB) ..... 1515241.6

(51) Int. Cl.
*B61L 25/02* (2006.01)
*B61L 27/00* (2006.01)
*G07C 5/00* (2006.01)

(52) U.S. Cl.
CPC ..... *B61L 25/026* (2013.01); *B61L 25/025* (2013.01); *B61L 27/0077* (2013.01); *B61L 27/0094* (2013.01); *G07C 5/008* (2013.01)

(58) Field of Classification Search
CPC .. B61L 25/025; B61L 25/026; B61L 27/0077; B61L 27/0094; G07C 5/008
USPC ..... 701/19
See application file for complete search history.

(56) References Cited

U.S. PATENT DOCUMENTS 6,081,769 A * 6/2000 Curtis ..... B61L 1/14 246/122 R
6,218,961 B1 * 4/2001 Gross ..... B60T 7/22 246/122 R
2012/0001029 A1 * 1/2012 Kondo ..... B61L 15/0027 246/108

(Continued)

*Primary Examiner* — Charles J Han
(74) *Attorney, Agent, or Firm* — Miles & Stockbridge PC

(57) ABSTRACT

A method of locating train events on a railway network is provided. The method includes the steps of: providing a reference point database which specifies locations of reference points on the network, the reference points being of different types, and the reference point database further specifying the respective type of each reference point; providing a relationship database which relates different train events to respective reference point types, for each combination of a train event and a related reference point type, the relationship database specifying a distance threshold criterion for the reference point type relative to a location of the event, and a reference point adjustment vector which specifies a distance from a reference point in a given direction on the network; receiving an event report for a train operated on the network, the report identifying a train event and imputing a location of the event on the network; comparing the event report with the reference point database and the relationship database to identify a reference point on the network which is of a type related in the relationship database to the train event of the event report, and which has a location on the network relative to the imputed location which satisfies the respective distance threshold criterion; and specifying the location of the train event of the event report to be the location of the identified reference point adjusted by the respective reference point adjustment vector.

15 Claims, 4 Drawing Sheets

(56) References Cited

U.S. PATENT DOCUMENTS

2016/0055750 A1* 2/2016 Linder ..... G08G 1/16
340/905

* cited by examiner

LOCATING TRAIN EVENTS ON A RAILWAY NETWORK

FIELD OF THE INVENTION

The present invention relates to a method and a system for locating train events on a railway network.

BACKGROUND

Operational mistakes which occur when trains are run on a rail network, such as signalling system failures or driver errors, generally involve interactions between network infrastructure and on-board train systems. It is increasingly popular to use Geographic Information Systems (GIS) to analyse railway operation and vehicle errors/malfunctions. In such a system a GIS tool or function maps train operation events according to recorded locations of the events. The locations can be recorded by an on-board locator, such a Global Positioning System (GPS) device or odometer information, or by a ground-side system.

However, the accuracy of event mapping has limitation due to locator accuracy, map accuracy and event record timing accuracy. For example, the measurement accuracy of GPS can vary from 5 to 100 m. Particularly in the vicinity of stations, the locations of reference points (typically specific items of network infrastructure) can have similar or smaller spacings. Separate from measurement accuracy error, the recording of train events may itself have time delays caused by the finite and variable times required, for example, data acquisition, processing, communication etc. Due to these issues, location measurement timings and event occurrence timings can vary, causing inaccuracies in the recorded locations of events.

Because of these limitations, an operator (such as a user of condition monitoring and data analysis systems) can have difficulties understanding relationships between events and infrastructure. In particular, if a mapping error is large, the operator may not recognize that an event has occurred at a certain item of infrastructure rather than just somewhere close to it.

One option is simply to improve location measurement accuracies, but this can be costly and time-consuming to implement. Thus it would be desirable to provide alternative approaches to improve event mapping on a railway network.

SUMMARY

In general terms, the present invention uses known relations between types of network reference point (for example types of infrastructure) and train events to correctly specify locational relations between the reference point and the events.

In a first aspect the present invention provides a method of locating train events on a railway network, the method including the steps of:

providing a reference point database which specifies locations of reference points on the network, the reference point database further specifying a respective type of each reference point;

providing a relationship database which relates different train events to respective reference point types, for each combination of a train event and a related reference point type, the relationship database specifying a distance threshold criterion for the reference point type relative to a location of the event, and a reference point adjustment vector which specifies a distance from a reference point in a given direction on the network;

receiving an event report for a train operated on the network, the report identifying a train event and imputing a location of the event on the network;

comparing the event report with the reference point database and the relationship database to identify a reference point on the network which is of a type related in the relationship database to the train event of the event report, and which has a location on the network relative to the imputed location which satisfies the respective distance threshold criterion; and specifying the location of the train event of the event report to be the location of the identified reference point adjusted by the respective reference point adjustment vector.

Advantageously, the method can thus improve the mapping of train events without requiring improved measurement accuracies for the locations of those events. In particular, although the accuracy of the positioning of the event on the network may not necessarily be improved by the method, by specifying the location of the event relative to a reference point, such improved mapping can help an operator to better understand location-related data. Thus it is to be understood that the terms "imputing" and "imputed" as used herein do not necessarily mean that the initial location of the event in the event report is less accurate than its ultimately specified location.

Further aspects of the present invention provide: a computer program comprising code which, when run on a computer, causes the computer to perform the method of the first aspect; a computer readable medium storing a computer program comprising code which, when run on a computer, causes the computer to perform the method of the first aspect; and a computer system programmed to perform the method of the first aspect.

For example, a computer system (corresponding to the first aspect) can be provided for locating train events on a railway network the system including:

a reference point database which specifies locations of reference points on the network, the reference point database further specifying a respective type of each reference point;

a relationship database which relates different train events to respective reference point types, for each combination of a train event and a related reference point type, the relationship database specifying a distance threshold criterion for the reference point type relative to a location of the event, and a reference point adjustment vector which specifies a distance from a reference point in a given direction on the network; and one or more processors configured to perform the steps of:

(a) receive an event report for a train operated on the network, the report identifying a train event and imputing a location of the event on the network;

(b) compare the event report with the reference point database and the relationship database to identify a reference point on the network which is of a type related in the relationship database to the train event of the event report, and which has a location on the network relative to the imputed location which satisfies the respective distance threshold criterion; and (c) specify the location of the train event of the event report to be the location of the identified reference point adjusted by the respective reference point adjustment vector The databases of the example system may be stored on computer-readable medium or media. The system may further include: a display device for displaying the specified location of the train event on a map of the network.

Optional features of the invention will now be set out. These are applicable singly or in any combination with any aspect of the invention.

The relationship database may further specify one or more operational criteria for each combination of a train event and a related reference point type, and in the comparing step the event report may also satisfy the one or more operational criteria. For example, in the case of a combination which has electric noise as the event, an operational criteria can be that the train electric power must be on. By means of such operational criteria, the reference point identification can be facilitated.

The method may further include preliminary steps of: operating a train on the network; and monitoring the train operation and creating the event report when the monitored operation satisfies predetermined detection criteria.

The relationship database may further specify a respective priority level for each combination of a train event and a related reference point type. In the comparing step, a plurality of reference points may be initially identified, and one of the initially identified reference points may then be selected for use in the subsequent specifying step on the basis of the respective priority levels. Thus the use of priority levels can be of assistance when several possible reference points are initially identified.

The receiving, comparting and specifying steps may be repeated for plural event reports.

Conveniently, the method may further include the step of: displaying the specified location(s) of the train event(s) on a map of the network.

The reference point locations can be the locations of network infrastructure, such as signals, stations, switches, track sections, neutral sections, AC/DC changeovers, points, bridges, tunnels, third rails, track geometries (such as curvatures and/or gradients), train operation locations (such as high speed locations, speed restriction locations, braking locations, stopping locations, horn operation locations, door operation locations and/or circuit breaker operation locations) etc. Thus the types of reference point specified in the database can include types of such network infrastructure.

However, the method can be extended to allow the positions of train events to be specified relative to other (reference) train events. This can be achieved by entering reference train events into the reference point database, such that reference train events can also be reference points. The locations of the reference train events are typically not fixed (like items of network infrastructure are typically fixed), but can be at arbitrary locations on the network. For example, the method may further include preliminary steps of: receiving a reference event report for a train operated on the network, the reference report identifying a reference train event and specifying a location of the reference event on the network; and updating the reference point database to specify the location of the reference event as a reference point on the network, the updated reference point database further specifying the respective type of the reference event. For example, the types specified in the database for reference events can include one or more event types selected from the group consisting of: electrical noise, mechanical noise, braking, horn operation, door operation, circuit breaker operation etc. Thus in this way, reference train events can be treated identically to infrastructure locations. Conveniently, the reference point database can have an infrastructure part which specifies the locations of network infrastructure reference points on the network, and a reference event part which specifies the location of reference events as event reference points on the network. Advantageously, the infrastructure part, which typically is large, complex and relatively unchanging, does not then need to be updated whenever a reference event is created or deleted.

The method can be extended to allow the positions of local events on a train to be determined, e.g. the positions of events associated with specific train cars or components (doors etc.). More particularly, the method of may further include the steps of: providing a relative location database which specifies, for each of plural locations on the train, an internal adjustment vector which specifies a distance from a reference point on the train to that location in a given direction along the train; receiving an internal event report for the train, the internal event report identifying a train internal event and a location of the event on the train; and creating a secondary event report identifying the train internal event and the train reference point; wherein the secondary event report is used as the event report in the receiving, comparing and specifying steps; and wherein the method further includes the step of: determining the location of the train internal event to be the specified location of the identified reference point adjusted by the internal adjustment vector. The use of a separate relative location database is convenient because train internal distances are easily determined from train design data. Depending on the train involved, an operator can readily select an appropriate relative location database for that train or make necessary adjustments to the relative location database, rather than having to adjust the reference point database or the relationship database. The method may further include the step of: displaying the determined location of the train internal event on a map of the network.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

Figure 1:
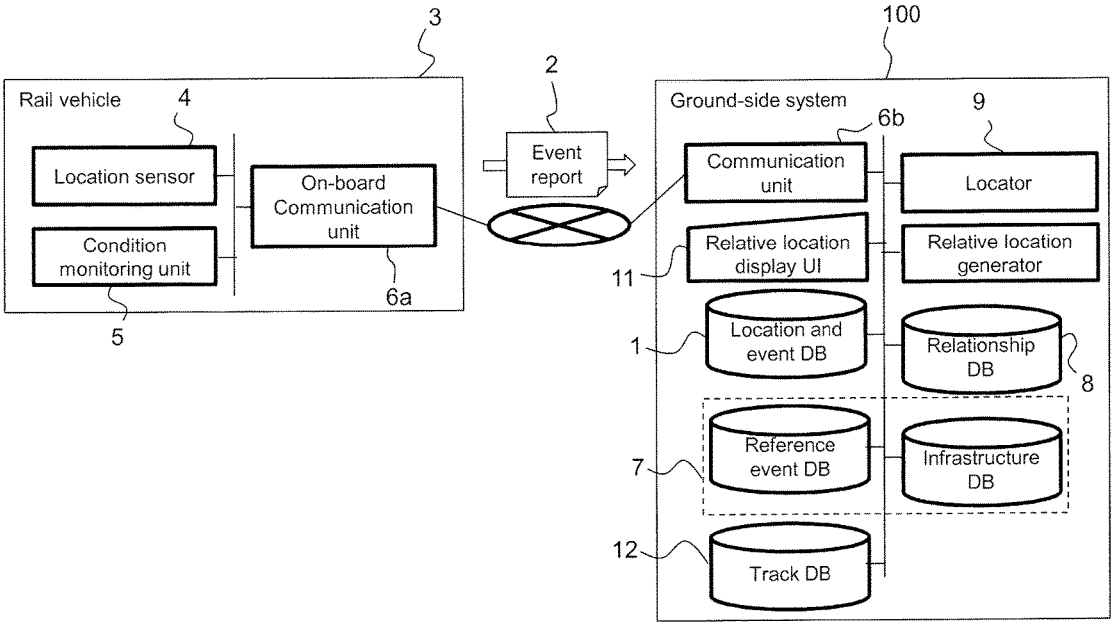
FIG. 1 shows overview of an architecture of a system for locating train events on a railway network.

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention.

Specific details are given in the following description to provide a thorough understanding of the embodiments. However, it will be understood by one of ordinary skill in the art that embodiments maybe practiced without these specific details. For example, well-known circuits, processes, algorithms, structures, and techniques may be shown without unnecessary detail in order to avoid obscuring the embodiments.

Also, it is noted that embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

As disclosed herein, the term "computer readable medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

FIG. 1 shows an overview of an architecture of a system 100 for locating train events on a railway network. The system includes a location and event database 1 which contains event reports 2 produced by train 3 on-board systems. Each event report specifies an event and the imputed location of the event. The on-board systems include a location sensor 4, such as a GPS or odometer device, to impute a location of the train. They also include condition monitoring systems 5 which obtain sensor measurements such as signalling data, cab operation monitoring data, etc. Each train has a communication unit 6*a* which transmits the event reports to the location and sensor/event database 1 via a ground-side communication unit 6*b* of the system 100. Either or both units 6*a*, 6*b* can pre-process the location data and sensor measurements to improve the location accuracy by combining data from multiple sensors and/or by referring to a map. Additionally or alternatively, either or both units 6*a*, 6*b* can detect events based on the application of detection logic (such as thresholding, or if-then testing) to the sensor measurements. The data transmission to ground-side can be performed in real time (e.g. wirelessly) or by batch transfer e.g. at the end of a journey or group of journeys.

Although not shown in FIG. 1, rather than detecting the events on-board the train 3, such detection can be performed ground-side, e.g. as part of the system 100. In this case, the train can simply transmit location data and sensor measurements.

The system 100 may have an optional locator unit 9 to pre-process the imputed locations of the events and improve their accuracy by combining multiple data source and/or map matching.

The system 100 contains a track database 12 which stores track geometry data and a reference point database 7 which stores the latitude-longitude coordinates (or other location codings) of reference points on network routes. The reference point database can be in two parts: an infrastructure part for the locations of infrastructure reference points and a reference event part for the locations of reference events. However, if the system is not required to specify the positions of train events relative to other (reference) train events, the reference point database 7 may be formed by just the infrastructure part.

TABLE 1

| | | Location | | |
|---|---|---|---|---|
| Name | Type | Route | Point on route | Direction |
| Signal 1 | Signalling system A | Line A | 11,120 m | Up |
| Signal 2 | Signalling system A | Line A | 11,600 m | Up |
| Signal 3 | Signalling system B | Line A | 124 m | Down |
| Neutral section 1 | Neutral section | Line A | 6,464 m | Up |
| Station 1 | Station | Line A | 50 m | Up |
| Station 2 | Station | Line A | 545,451 m | Up |
| Switch 1 | Switch | Line B | 22,476 m | Down |
| Slippery location 1 | Slippery location | Line B | 5,000 m | Down |

Table 1 shows a schematic example of a portion of the infrastructure part of the reference point database 7. Each row is a separate database record and specifies the name and type (e.g. signalling system A, signalling system B, neutral section, station, switch, slippery location) of eight different infrastructure reference points. The location of each reference point is coded by reference to a given network route (line A or B), and point on that route, and a direction along the route.

In addition, the system 100 contains a relationship database 8 which stores pre-defined knowledge defining relationships between types of event and types of reference point.

TABLE 2

| Event | Reference point type | Adjustment vector | Distance threshold | Criteria | Priority |
|---|---|---|---|---|---|
| Electric noise | Neutral section | 0 m | 100 m | Event occurred within 100 m of reference point | Medium |

TABLE 2-continued

| Event | Reference point type | Adjustment vector | Distance threshold | Criteria | Priority |
|---|---|---|---|---|---|
| | | | | Event occurred when train power is on<br>Train running in same direction of reference point | |
| Signalling failure A | Signalling system A | +20 m | 150 m | Event occurred within 150 m of reference point<br>Train running in same direction of reference point | High |
| Wheel slip | Slippery location | +50 m | 300 m | Event occurred within 300 m of reference point | Low |
| Electric component failure | Electric noise | +10 m | 50 m | Event occurred within 50 m of reference point<br>Train running in same direction of reference point | Medium |

Table 2 shows a schematic example of a portion of the relationship database 8. Each row is a separate database record and specifies a respective combination of a train event (electric noise, signalling failure A, wheel slip or electric component failure) and a reference point type (neutral section, signalling system A, slippery location or electric noise). Also provided for each combination is a distance threshold criterion defined in terms of a distance threshold and optionally a running direction, and an adjustment vector. Some combinations may specify other criteria. For example, in Table 2 the combination of electric noise and a neutral section has an additional operational criterion which specifies that the train power must be on. In addition, each combination can be given a priority level.

The first three records of Table 2 have reference point types which are items of network infrastructure. The fourth record of Table 2 is different in that the reference point type refers to an event (electric noise) which can, in principal, be at any location on the network rather than being tied to one or more specific items of infrastructure. To make use of such records, the reference point database 7 can be enhanced to store reference train events. For example, the database 7 can also have the reference event part shown in FIG. 1 for non-positionally fixed, reference train events. The reference event part may be created just on RAM, as it is not generally required to be permanent. When a reference event report for a train operated on the network is received, the reference report identifies a reference train event (e.g. electric noise) and specifies a location of the reference event on the network. The reference event part of the database 7 can then record the reference event. Thus Table 3 shows a list of reference points, most being infrastructure reference points (and thus corresponding to the entries of Table 1), but the last entry in the Table being a reference event reference point.

TABLE 3

| Name | Type | Location | | |
|---|---|---|---|---|
| | | Route | Point on route | Direction |
| Signal 1 | Signalling system A | Line A | 11,120 m | Up |
| Signal 2 | Signalling system A | Line A | 11,600 m | Up |
| Signal 3 | Signalling system B | Line A | 124 m | Down |

TABLE 3-continued

| Name | Type | Location | | |
|---|---|---|---|---|
| | | Route | Point on route | Direction |
| Neutral section 1 | Neutral section | Line A | 6,464 m | Up |
| Station 1 | Station | Line A | 50 m | Up |
| Station 2 | Station | Line A | 545,451 m | Up |
| Switch 1 | Switch | Line B | 22,476 m | Down |
| Slippery location 1 | Slippery location | Line B | 5,000 m | Down |
| Electric noise | Electric noise | Line A | 7,500 m | Up |

Figure 2:
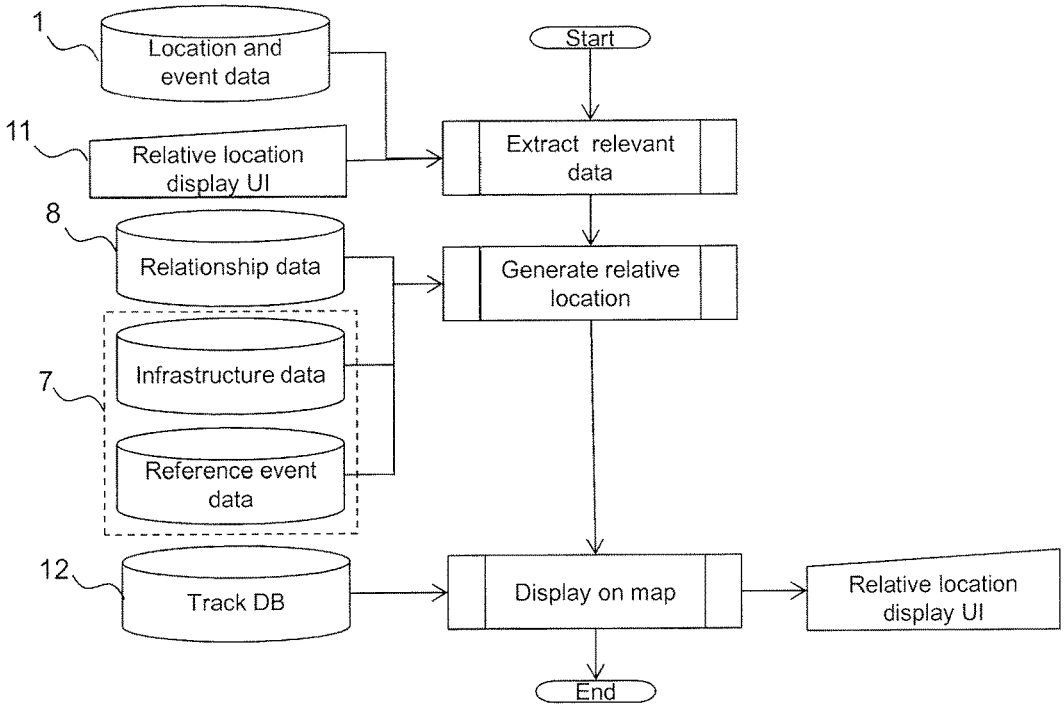
FIG. 2 shows an overview flowchart of a procedure for locating train events implemented by the system of FIG. 1.

When an operator, such as maintenance engineer or controller, tries to review the event report data, e.g. on a map or other user interface 11 of the system 100, a procedure for locating train events is triggered. This is shown in the overview flowchart of FIG. 2. An event report selected by the operator on the user interface is extracted from the location and event database 1. The event is matched to the records of the relationship database 8 to identify reference point types which may be associated with the event. For example, with reference to Table 2, if the event is electric noise, then a possible reference point type is neutral section. As a second example, if the event is electric component failure, then a possible reference point type is electric noise. Along with the possible reference point type, the relationship database also provides a corresponding distance threshold criterion and an adjustment vector. The infrastructure part (and the reference event part if in use) of the reference point database 7 is accessed to identify an actual reference point of the possible type which satisfies the distance threshold criterion. Using the track database 12, the event can then be displayed on a map of the network, with the position of the event being given as the position of the identified reference point adjusted by the adjustment vector. In the first example where the event is electric noise and the reference point type is neutral section, the result is that the event position is specified relative to network infrastructure. In the second example where the event is electric component failure and the reference point type is electric noise, the result is that the event position is specified relative to the location of a previous reference event.

Figure 3:
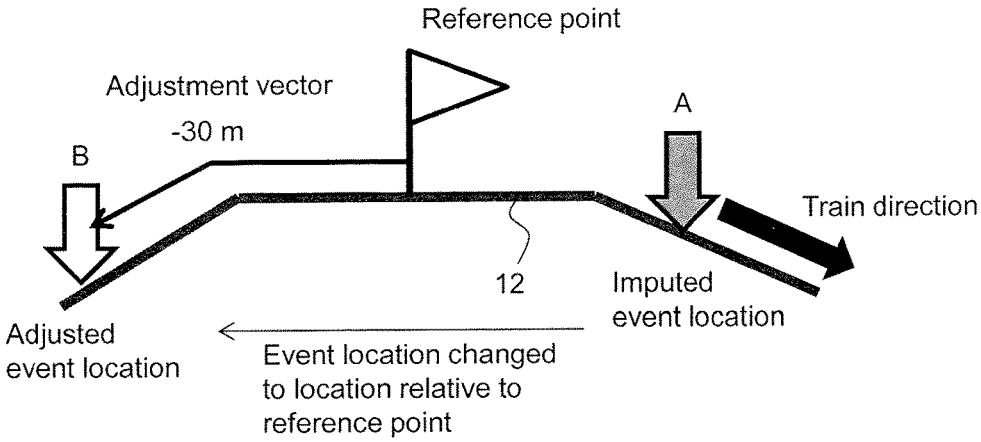
FIG. 3 shows schematically adjustment to the location of an event.

The result of this procedure is illustrated schematically in FIG. 3, which shows a part of a route 12 of a rail network, and a position of a reference point on that route. An event report provides an imputed location for an event at position A to the right (up direction) of the reference point. This event, however, is associated to the type of the reference point in the relationship database 8, and further the event satisfies the corresponding distance threshold criterion. The location of the event is thus adjusted to position B, which is the location of the reference point adjusted by the corresponding adjustment vector (30 m in the down direction).

Figure 4:
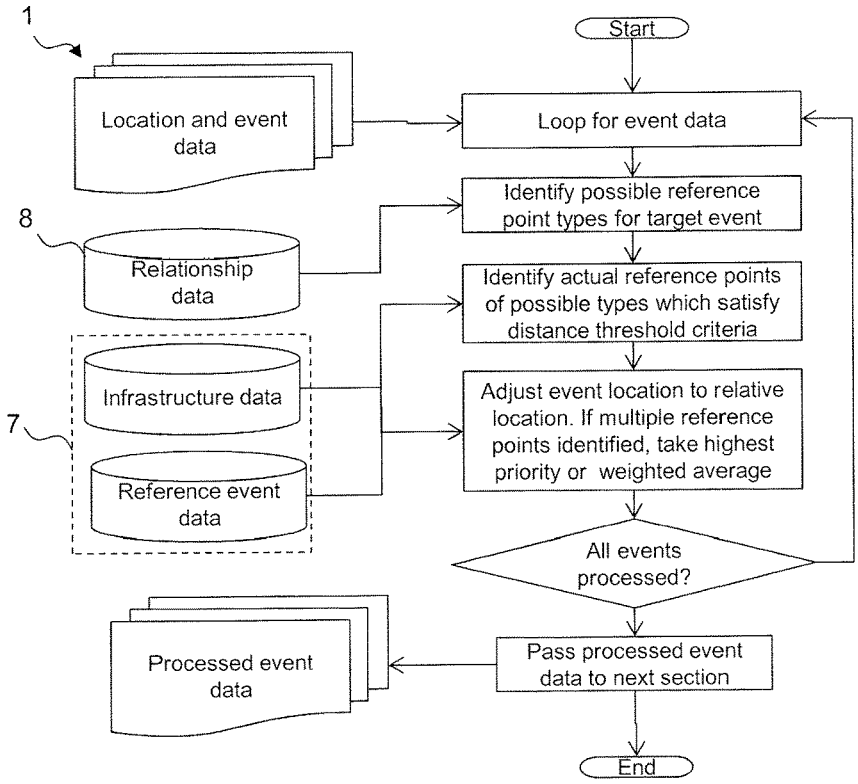
FIG. 4 shows a flowchart of the procedure of FIG. 2 in the context of a loop over plural event reports.

FIG. 4 shows this procedure in the context of a loop over all event reports in the location and event database 1, allowing for the locations of all the events to be adjusted when triggered by an operator. As shown in FIG. 4, if more than one reference point can be matched to a given event report, one option is to accept just the reference point which has the highest priority according to the stored priorities of the relationship database 8, or which best fits to the event report. Another option is to take a weighted average for the adjusted event location (e.g. a weighted average according to priority level). A further option in the case of conflict is simply not to adjust the location of the event. In this case, the event can be flagged as subject to a conflict.

Figure 5:
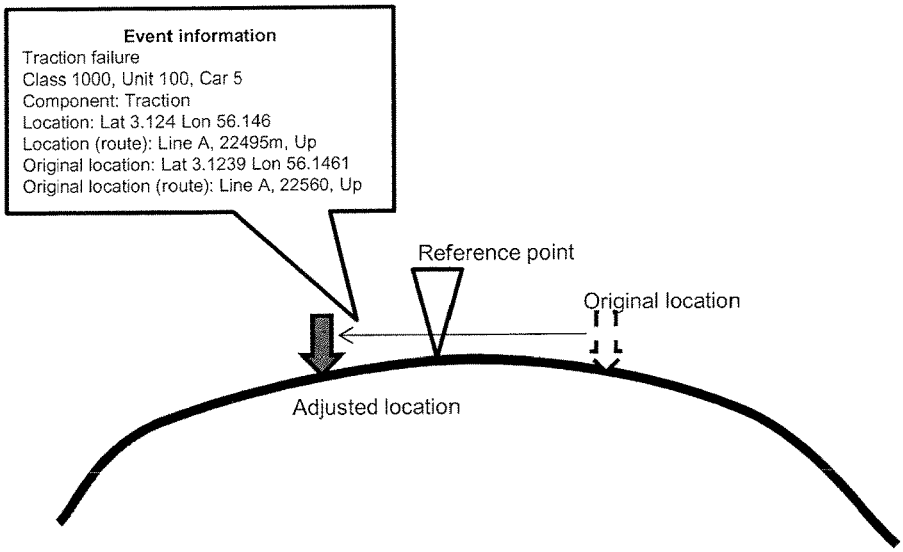
FIG. 5 shows an example of a map display for an adjusted point of interest.

When all the events have been processed, they can be displayed, for example on a map or as a list of events. In a map display, it is also possible to show the originally recorded (imputed) location, or some other information that signifies that the currently displayed location is an adjusted location. FIG. 5 shows example of such a map display for just one reference point. Although the adjusted location of the event may not be more accurate than the originally recorded location, by displaying the adjusted location relative to the reference point, an operator can better understand the likely relation between the event and the reference point.

Figure 6:
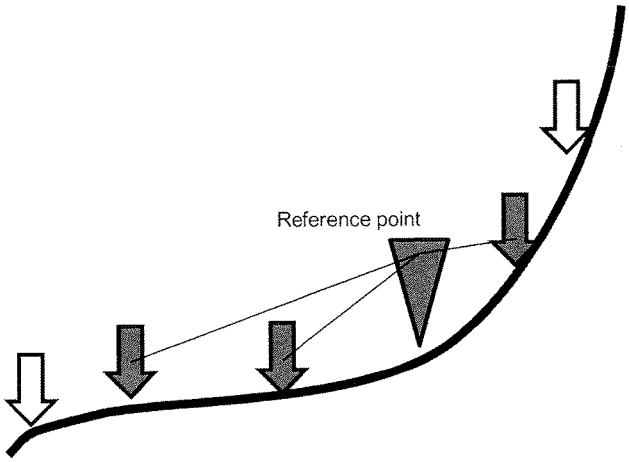
FIG. 6 shows schematically display association of a reference point with connected events.

In the map display, all the events associated with a given reference point can, for example, share the same icon or colour, or be connected by line to the reference point to signify the association between the events, as shown in FIG. 6 in which a reference point and its associated events are shaded in grey and connected by lines while non-associated events are in white. Such association can be shown in the map display before adjustment of the event locations. Another option is only to show reference point/event associations on the display when prompted by an operator action such as mouse over or clicking, tapping a touch screen, choosing from a list etc.

When an operator believes an adjusted event location is wrong, the map display may allow the operator to drag the event along the network route to a different location.

In a list of events, the adjusted event location can be shown in the form of a position on a map (typically as the distance from the start of a route or from a reference point on the route) or in latitude/longitude format. It is also possible to add a notification alerting that the location is adjusted.

The relationships between types of event and types of reference point which form the relationship database 8 can be created in a number of ways. One option is to create them manually. However automatic learning approaches are also possible. For example, relationships can be inferred from spatio-temporal correlations between train events and reference points. Similarly, the distance threshold criteria can be created manually or by analysis of the statistics of distances between event and reference points.

The proper functioning of the system depends to a significant extent on the accuracy with which the locations of the reference points are specified in the reference point database 7. If events persistently fall outside the distance threshold criterion of a reference point, this may be an indication that the reference point location has been incorrectly specified. Thus the system can flag such persistent failings to the operator to prompt investigation of the possibility that the reference point location has been incorrectly specified.

The system can be used for cases which require high accuracy in locating events. Thus trains can extend for hundreds of meters in length, with cars and components distributed along the train and thus having different locations. The location of a train as a whole is typically defined by some reference point on the train, such as a GPS antenna or a cab position. However, it is possible to provide a relative location database for events local to each car/component according to the distance of that car/component from the train reference point. This database can then be used in combination with the system described above to determine accurate locations of the local events. In particular a secondary event can be associated with the train reference point whenever a local event occurs on the train. When the location of the secondary event is adjusted as described above with reference to a reference point, the location of the local event can then be determined relative to that adjusted location using a further internal adjustment vector.

The use of a separate relative location database is convenient because train internal distances are easily determined from train design data. Depending on the train involved, an operator can easily select an appropriate relative location database for that train or make necessary adjustments to the relative location database.

Figure 7:
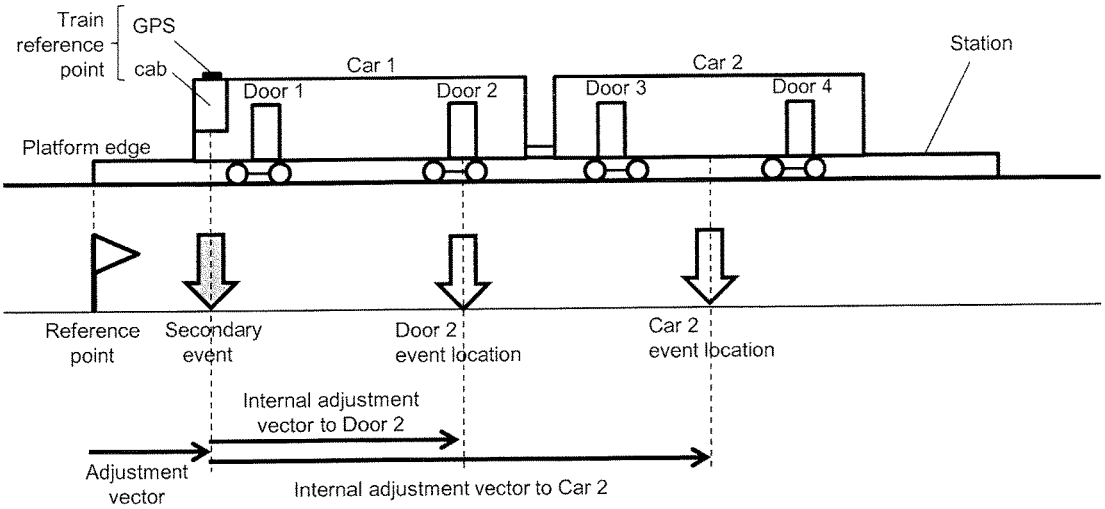
FIG. 7 shows schematically a procedure for locating events which occur at localised positions on a train.

The approach is illustrated with reference to FIG. 7. When the train is stopped at a station platform, the locations of the train cars and doors are distributed along the platform. It is difficult to measure station locations accurately using GPS as station structures interfere with GPS satellite signals. However, if internal events occur on the train, location accuracies of only a few meters are typically required.

However, the train has a GPS or cab-based train reference point, and the station has a reference point which is the location of the edge of the platform. The stopping position of the train at the platform is pre-defined, and the reference point has an associated adjustment vector in the relationship database which is the distance from the platform edge to the position of the train reference point when the train is at the pre-defined stopping position. Two examples of local events are illustrated in FIG. 7, one is at Door 2 (e.g. Door 2 does not open) and the other is at Car 2 (e.g. all doors of Car 2 malfunction). Each of these local events prompts the creation of a secondary event report associated with the train reference point. When the secondary event is matched to the platform edge reference point, the adjustment vector correctly positions the train reference point relative to the pre-defined stopping position, and internal adjustment vectors for the positions of Door 2 and Car 2 relative to the train reference point can then be extracted from the relative location database to correctly determine the locations of their local events relative to the adjusted position of the train reference point.

If the train overruns the platform such that it does not stop at its pre-defined stopping position, the creation of the secondary event report can be suppressed. Further, the train overrun would typically lead to the creation of a separate event report for the train.

The invention claimed is:

1. A method of locating train events on a railway network, the method comprising the steps of:

providing a reference point database which specifies locations of a plurality of reference points on the railway network, the reference point database further specifying a respective reference point type of each said reference point;

providing a relationship database which relates each of a plurality of different train events to at least one of said reference point types, for each combination of a train event and a related reference point type, the relationship database specifying a distance threshold criterion for each said reference point type relative to a location of an associated train event, and a reference point adjustment vector which specifies a distance from a reference point in a given direction on the railway network;

receiving an event report for a train operated on the railway network, the event report identifying one of said plurality of train events and imputing a location of said one train event on the railway network;

comparing the event report with the reference points in the reference point database and the train events in the relationship database by identifying a reference point on the railway network which is of a reference point type related in the relationship database to the train event of the event report, and which has a location on the railway network relative to the imputed location which satisfies the respective distance threshold criterion; and specifying the location of the train event of the event report to be the location of the identified reference point adjusted by a reference point adjustment vector which is stored in the relationship database and which is associated with the identified reference point, wherein the reference point adjustment vector specifies a given distance along the railway network based on a railway network impairment signal received from the railway network.

2. The method of locating train events according to claim 1, wherein:

the relationship database further specifies one or more operational criteria for each combination of a train event and a related reference point type, and in the comparing step, the event report also satisfies the one or more operational criteria.

3. The method of locating train events according to claim 1, further comprising preliminary steps of:

operating a train on the railway network; and monitoring the operation of the train and creating the event report when the monitored operation satisfies predetermined detection criteria.

4. The method of locating train events according to claim 1, wherein:

the relationship database further specifies a respective priority level for each combination of a train event and a related reference point type, and the comparing step further comprises initially identifying a plurality of reference points, and selecting one of the initially identified reference points for use in the subsequent specifying step on the basis of the respective priority levels.

5. The method of locating train events according to claim 1, wherein the receiving, comparing, and specifying steps are repeated for plural event reports.

6. The method of locating train events according to claim 1, further comprising the step of:

displaying the specified location of the train event of the event report on a map of the railway network.

7. The method of locating train events according to claim 6, wherein in the displaying step, the reference points are displayed on the map.

8. The method of locating train events according to claim 6, wherein in the displaying step, the imputed location of the train event is displayed on the map.

9. The method of locating train events according to claim 6, wherein in the displaying step, the event report is displayed on the map.

10. The method of locating train events according to claim 1, wherein the types of reference points specified in the database include one or more network infrastructure types selected from the group consisting of: signals, stations, switches, track sections, neutral sections, AC/DC changeovers, points, bridges, tunnels, third rails, track geometries, and train operation locations.

11. The method of locating train events according to claim 1, further comprising the preliminary steps of:

receiving a reference event report for a train operated on the railway network, the reference report identifying a reference train event and specifying a location of the reference event on the railway network; and updating the reference point database to specify the location of the reference event as a reference point on the railway network, the updated reference point database further specifying the respective type of the reference event.

12. The method of locating train events according to claim 1, further comprising the steps of:

providing a relative location database which specifies, for each of a plurality of locations on the train, an internal adjustment vector which specifies a distance from a reference point on the train to each said location on the train in a given direction along the train;

receiving an internal event report for the train, the internal event report identifying a train internal event and a location of the train internal event on the train; and creating a secondary event report identifying the train internal event and the train reference point, wherein the secondary event report is used as the event report in the steps of receiving an event report, comparing the event report, and specifying the location of the train internal event of the train report, and wherein the method further comprises determining the location of the train internal event on the train to be a specified location of the identified reference point adjusted by an internal adjustment vector which is stored in the relationship database.

13. The method of locating train events according to claim 12, further comprising the step of:

displaying the determined location of the train internal event on a map of the railway network.

14. A system comprising:

a reference point database which specifies locations of a plurality of reference points on a railway network, the reference point database further specifying an associated type of each reference point;

a relationship database which relates a plurality of different train events to the plurality of reference point types, for each combination of one of said plurality of train events and a corresponding one of said plurality of related reference point types, the relationship database specifying a distance threshold criterion for each said reference point type relative to a location of the corresponding train event, and a reference point adjustment vector which specifies a distance from a reference point in a given direction on the railway network; and one or more processors configured to:

receive an event report for a train operated on the railway network, the event report identifying one of said plurality of train events and imputing a location of said one train event on the railway network, compare the event report with reference points in the reference point database and train events in the relationship database to identify a reference point on the railway network which is of a type related in the relationship database to the train event of the event report, and which has a location on the railway network relative to the imputed location which satisfies the respective distance threshold criterion, and specify the location of the identified train event of the event report to be the location of the identified reference point adjusted by a respective reference point adjustment vector stored in the relationship database, wherein the reference point adjustment vector specifies a given distance along the railway network based on a railway network impairment signal received from the railway network.

15. A non-transitory computer readable medium storing a sequence of programmed instructions which, when executed by one or more processors, causes the one or more processors to perform the following steps:

provide a reference point database which specifies locations of a plurality of reference points on a railway network, the reference point database further specifying an associated type of each said reference point;

provide a relationship database which relates a plurality of different train events to the plurality of reference point types, for each combination of one of said plurality of train events and a corresponding one of said plurality of related reference point types, the relationship database specifying a distance threshold criterion for each said reference point type relative to a location of the corresponding train event, and a reference point adjustment vector which specifies a distance from a reference point in a given direction on the railway network;

receive an event report for a train operated on the railway network, the event report identifying one of said plurality of train events and imputing a location of said one train event on the railway network;

compare the event report with the reference points in the reference point database and train events in the relationship database to identify a reference point on the railway network which is of a type related in the relationship database to the train event of the event report, and which has a location on the railway network relative to the imputed location which satisfies the respective distance threshold criterion; and specify the location of the identified train event of the event report to be the location of the identified reference point adjusted by a respective reference point adjustment vector stored in the relationship database, wherein the reference point adjustment vector specifies a given distance along the railway network based on a railway network impairment signal received from the railway network.

* * * * *